United States Patent [19]

Greiner et al.

[11] Patent Number: 4,589,492

[45] Date of Patent: May 20, 1986

[54] SUBSEA WELL SUBMERSIBLE PUMP INSTALLATION

[75] Inventors: Tom D. Greiner, Vinita; Raymond L. Guzy, Tulsa; Dick L. Knox, Claremore, all of Okla.

[73] Assignee: Hughes Tool Company, Houston, Tex.

[21] Appl. No.: 659,489

[22] Filed: Oct. 10, 1984

[51] Int. Cl.[4] ..... E21B 33/035; E21B 43/01

[52] U.S. Cl. ..... 166/338; 166/65.1; 339/35; 339/96; 339/117 R; 339/126 RS

[58] Field of Search ..... 166/65 R, 338, 85; 339/75 R, 117 R, 117 P, 94 R, 35, 34, 96, 126 RS, 60 R, 59 R

[56] References Cited

U.S. PATENT DOCUMENTS

| | | | |
|---|---|---|---|
| 3,508,188 | 4/1970 | Buck | 339/117 R |
| 3,522,576 | 8/1970 | Cairns | 339/96 |
| 3,638,732 | 2/1972 | Huntsinger et al. | 166/65 R |
| 3,848,949 | 11/1974 | Falkner | 339/96 |
| 3,976,347 | 8/1976 | Cooke, Sr. et al. | 166/65 R |
| 4,003,428 | 1/1977 | Zehren | 166/65 R |
| 4,109,989 | 8/1978 | Snyder, Jr. et al. | 339/96 |
| 4,289,199 | 9/1981 | McGee | 166/65 R |

FOREIGN PATENT DOCUMENTS

| | | | |
|---|---|---|---|
| 957324 | 9/1982 | U.S.S.R. | 339/75 R |
| 1030895 | 7/1983 | U.S.S.R. | 339/60 R |

*Primary Examiner*—James A. Leppink
*Assistant Examiner*—Hoang C. Dang
*Attorney, Agent, or Firm*—James E. Bradley

[57] ABSTRACT

A submersible pump installation for a subsea well has an electrical connection that is hydraulically made up with provisions to avoid contact with sea water. The submersible pump is suspended by a suspension head located in a tubular member at the subsea wellhead. An electrical insulator is movably carried in a passage extending through a wall of the tubular member. An electrical connector pin is carried in the insulator. A piston moves the insulator into contact with the suspension head, then the connector pin into engagement with the electrical connector located in the suspension head. A seal and dielectric fluid in the suspension head serve to prevent contamination by liquids in the subsea wellhead.

8 Claims, 3 Drawing Figures

SUBSEA WELL SUBMERSIBLE PUMP INSTALLATION

BACKGROUND OF THE INVENTION

1. Field of the Invention

This invention relates in general to submersible pump electrical connections, and in particular to an electrical connection located in a subsea well for connecting power cables of a submersible pump.

2. Description of the Prior Art

Submersible pumps of the type concerned herein are pumps having an electrical motor downhole which drives a centrifugal pump mounted above the motor. Power cables extend from the pump, which may be thousands of feet deep in the well, to the wellhead at the surface. The power cables at the surface are connected to a power source, normally a transformer connected to the utility lines.

In subsea wells that are located in fairly deep water, the Christmas tree or wellhead will be located on the ocean floor. There are several patents that disclose installing a submersible pump assembly in such a well, such as shown in U.S. Pat. No. 4,003,428, Zehren, Jan. 18, 1977, and the patents cited therein. When lowered to its proper place in the well, a connection must be made between the downhole interior power cables extending from the motor to the Christmas tree, and the exterior power cables extending from the Christmas tree to a power source at the surface. The '428 patent shows means for making this electrical connection without using a diver. However, the '428 patent does not address the possibility sea water being located in the environment surrounding the electrical connection. Even small amounts of sea water could cause faults because of the fairly high voltages and high power passing through the electrical connections.

SUMMARY OF THE INVENTION

An improved electrical connection is shown herein for use in connecting a subsea well submersible pump installation. The wellhead assembly includes a tubular member within which a suspension head for the submersible pump locates. The internal power cable extends from the motor to the suspension head, and an electrical connection to the external cable is made at the suspension head. An electrical insulator is movably carried in a passage located in the wellhead member adjacent the suspension head. An electrical connector is carried inside the insulator. Piston means moves the insulator into abutment against the suspension head, and moves the electrical connector in the insulator into engagement with the electrical connector in the suspension head. The movement of the insulator reduces the chance for sea water from entering the connection in the suspension head.

Preferably, the insulator is first moved into abutment with the suspension head, then the connector pin in the movable insulator is moved into engagement with the connector inside the suspension head. The connector pin is recessed initially within the movable insulator to avoid contact with the sea water. A movable barrier or piston inside the suspension head is penetrated by the connector pin during insertion. The piston in the suspension head squeezes dielectric fluid around the connection to further shield against the entry of contaminating liquid.

DESCRIPTION OF THE PREFERRED EMBODIMENT

Figure 1:
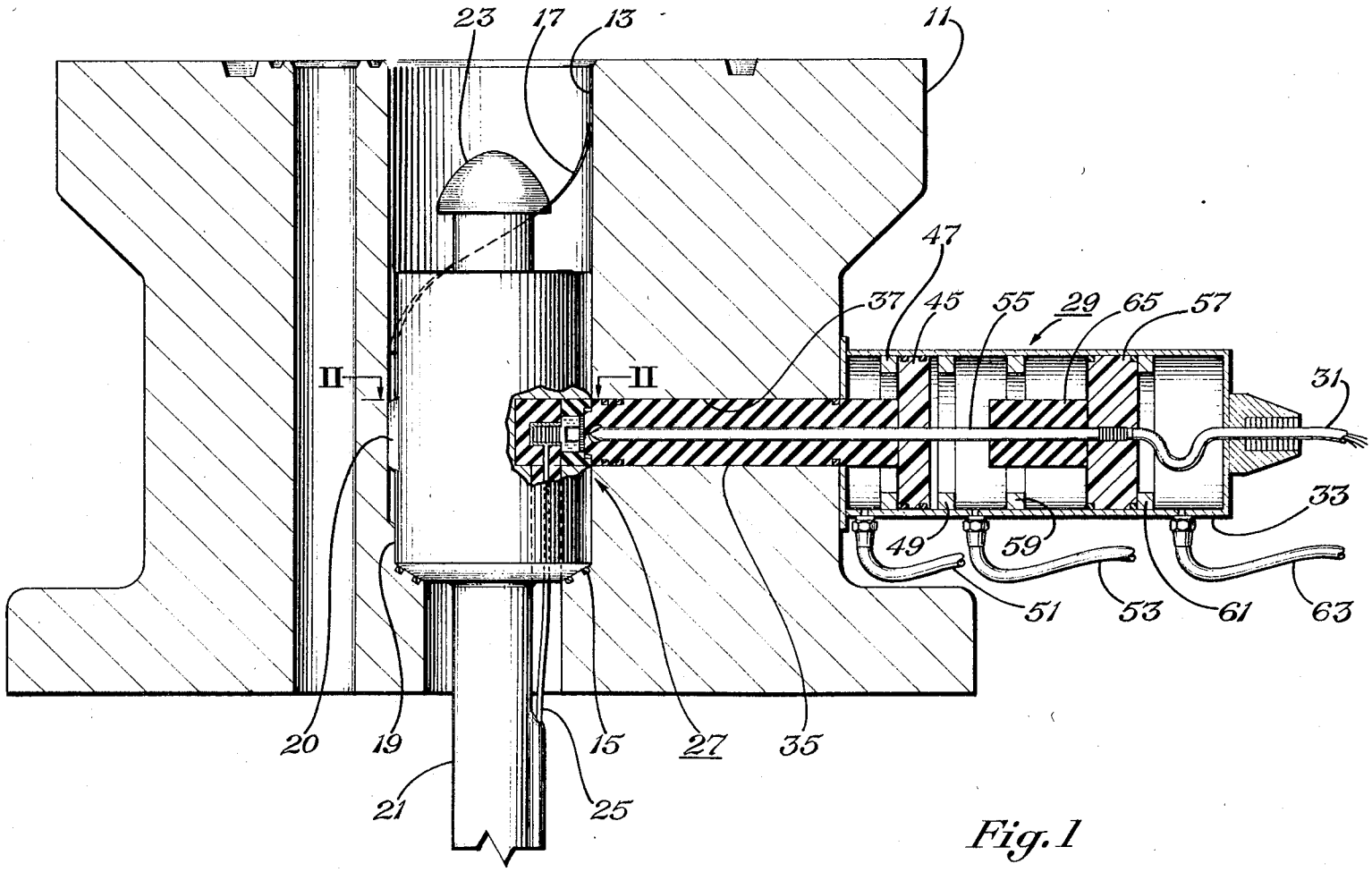
FIG. 1 is a cross-sectional view of an electrical connecting assembly for a submersible pump subsea wellhead installation constructed in accordance with this invention.

Referring to FIG. 1, a tubular member 11, which is part of a subsea well Christmas tree (not shown) has an axial passage 13. U.S. Pat. No. 4,003,428, Jan. 18, 1977, Zehren, shows more details of a Christmas tree of which tubular member 11 may be a part. Passage 13 has an upwardly facing shoulder 15. An orienting guide or groove 17 extends helically down the passage 13 above the shoulder 15. A suspension head 19 is adapted to locate on shoulder 15 for suspending a submersible pump (not shown). The submersible pump may be of a type as shown in the above-mentioned patent.

Suspension head 19 has a key or tab 20 that engages guide 17, causing suspension head 19 to rotate into the proper orientation as it is being lowered into the tubular member 11. Suspension head 19 has a lower portion 21 to which the submersible pump cable is secured. A neck 23 protrudes upwardly from suspension head 19 for receiving a handling tool of a type that may be as shown in the above-mentioned patent. Three electrical power cables 25 extend upwardly along the lower portion and into the suspension head 19. Cables 25 are used to transmit power down to the pump, and signals proportional to pressure and temperature may be superimposed on the power cables for transmission to the surface.

Figure 2:
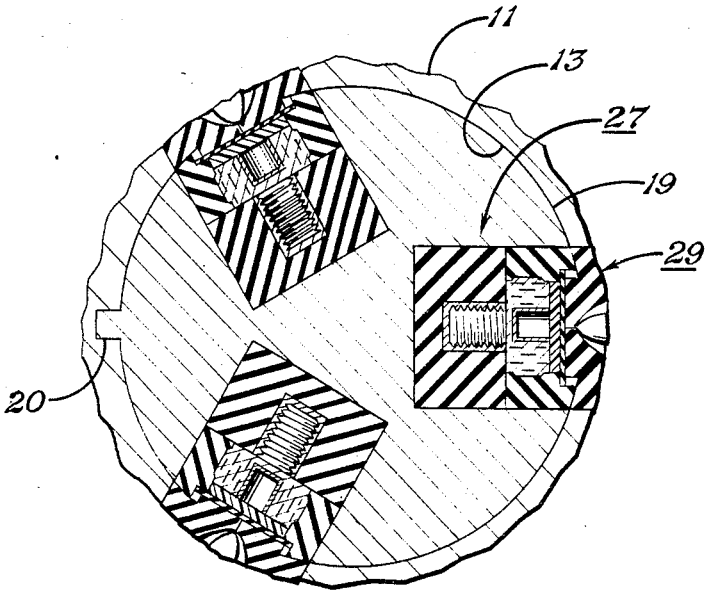
FIG. 2 is a cross-sectional view of the connector assembly of FIG. 1, taken along the line II—II of FIG. 1.

There are three inner connector assemblies 27 mounted 120 degrees apart in the suspension head 19, as shown in FIG. 2. The connector assemblies 27 face laterally outward and each are connected to one of the power cables 25 extending down into the well. The tubular member 11 has three mating outer connector assemblies 29 that will engage the inner connector assemblies 27 to transmit power from a power source (not shown) to the submersible pump downhole, and for receiving pressure and temperature signals in some cases for transmission to a readout instrument at a remote location. Each outer connector assembly 29 is connected to an external cable 31 leading to a remote location.

Figure 3:
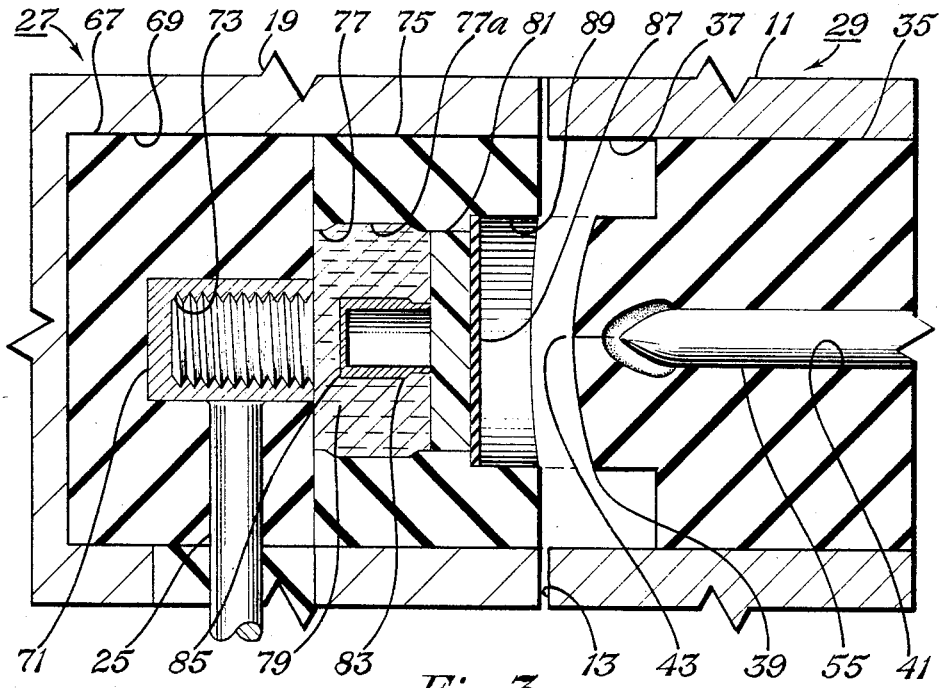
FIG. 3 is an enlarged view of a portion of the connector assembly of FIG. 1, with the inner and outer portions of the connector assembly shown prior to connection.

Each outer connector assembly 29 has a hydraulic cylinder or housing 33 mounted to a sidewall of tubular member 11. The outer connector assembly 29 also includes an outer insulator 35 that extends radially through a passage 37 located in the sidewall of the tubular member 11. Each passage 37 intersects the axis of passage 13 at a 90 degree angle. As shown in FIG. 3, each outer insulator 35 is a resilient member that provides electrical insulation and has a sealing face 39 on its inner end. Sealing face 39 is cylindrical, of smaller diameter than the diameter of outer insulator 35, and protrudes inwardly. Sealing face 39 is convex and concentric with the longitudinal axis of the outer insulator 35. A passage 41 extends longitudinally through the outer insulator 35 along the axis of the outer insulator 35. Passage 41 terminates in a slit 43 at the sealing face 39. Slit 43 remains in a closed position, as shown in FIG. 3, unless forced open.

A piston 45 is reciprocally carried in the hydraulic cylinder 33, as shown in FIG. 1. Piston 45 is formed of electrical insulation material, such as phenolic, and reciprocates between two stops 47 and 49. Hydraulic hoses 51 and 53 supply hydraulic fluid pressure to move the piston 45 between the inner and outer positions. Hoses 51 and 53 lead to a remote source of hydraulic pressure. The outer end of the outer insulator 35 is secured to the piston 45 for movement therewith. Piston 45 will move the outer insulator 35 from an outer or recessed position, generally as shown in FIG. 3 to an inner or protruding position as shown in FIG. 1. In the recessed position, the sealing face 39 will be recessed within passage 37 and will not protrude past the wall of passage 13.

An outer electrical connector, preferably a male connector pin 55 is reciprocally carried within the passage 41 of the outer insulator. Connector pin 55 is a metal pin with a pointed tip on its inner end. The outer end, as shown in FIG. 1, is rigidly secured to a piston 57 carried in the hydraulic cylinder 33. Piston 57 will reciprocate between stops 59 and 61. Hydraulic fluid pressure is supplied through a hydraulic hose 63 and hydraulic hose 53 from a source at a remote location. Piston 57 is made up of a non-electrically conductive material. An electrical insulator 65 extends around a portion of the pin 55, and will contact the inner piston 45 when piston 57 is moved to the inner position in contact with stop 59. The movement of piston 57 causes the connector pin 55 to move with respect to the outer insulator 35 and extend past the sealing face 39 through the slit 43.

Referring again to FIG. 3, an inner insulator 67 is located within a cavity 69 in the suspension head 19. Insulator 67 contains an inner connector 71. Inner connector 71 is bonded to the cable 25 and is electrically conductive. Inner connector 71 is preferably a female connector having a socket, a closed inner end, an open outer end and grooves or threads 73 contained within. Insulator 67 and connector 71 will remain permanently with the suspension head 19.

A removable insulator 75 is also located in the cavity 69 in the suspension head 19. Insulator 75 has a cavity 77 therein that has an axis that intersects the axis of the inner connector 71 and also coincides with the axis of the outer insulator passage 41 when the suspension head has landed. Cavity 77 contains a dielectric fluid 79, which is preferably a silicon gel that serves to prevent contact of electrically conductive liquids with the electrical connectors 71 and 55. Cavity 77 has a central enlarged area *77a* of slightly larger diameter than the remaining portions of the cavity 77.

A piston 81 is located in the cavity 77, with its axis coinciding with the axis of the inner connector 71. Piston 81 is made up of an insulating material that is soft enough to be penetrated by the pointed tip of the connector pin 55. Piston 81 has a diameter that is approximately the same as the diameter of cavity 77, but smaller than the diameter of the enlarged area *77a*, to allow the dielectric fluid 79 to flow around the piston 81 when it is moved toward the connector 71.

A metal, electrically conductive sleeve 83 is secured to the inner side of piston 81 for movement therewith. Sleeve 83 has a closed end 85 on its inner end. The outer diameter of sleeve 83 is approximately the inner diameter of the inner connector 71. The inner diameter of sleeve 83 is approximately the outer diameter of the connector pin 55. A flat rubber seal 87 extends across the outer face of the piston 81. Seal 87 is affixed within a recess 89, which is cylindrical and coaxial with the cavity 77. Seal 87 can be pierced by the tip of the connector pin 55. Recess 89 has a diameter the same as the sealing face 39 of the outer insulator 35. The depth of recess 89 is approximately the depth of the sealing face 39, so as to closely receive the sealing face 39 when the assemblies 27 and 29 are in the engaged position.

In operation, the tubular member 11 will be mounted into the Christmas tree of the subsea well. The outer connector assembly 29 will be connected to the tubular member 11. The pistons 45 and 57 will be in the retracted position. The sealing face 39 will be recessed within the 37 (FIG. 3), and the tip of the connector pin 55 will be recessed within the passage 41.

Electrical power cables 25 will be connected to inner connectors 71. The submersible pump is lowered into the well, through the tubular member 11 in a manner that may be as shown in the U.S. Pat. No. 4,003,428, previously mentioned. The key 20 of the suspension head 19 will contact the orienting guide 17 and rotate the suspension head 19 to align the inner connector assemblies 27 with the outer connector assemblies 29. Suspension head 19 will land on the shoulder 15 and support the submersible pump.

Once in place, hydraulic fluid pressure is supplied through hose 53 to move each piston 45 inward, with hydraulic fluid being returned from the hose 51. Each outer insulator 35 will move inwardly, and the sealing face 39 will enter the recess 89 and abut against the seal 87. Most of any sea water surrounding the suspension head 19 will be purged from recess 19 by the sealing face 39.

Then, hydraulic fluid pressure is supplied through hose 63 to push each piston 57 inwardly. Each connector pin 55 will extend through the slit 43 (FIG. 3), pierce the seal 87, and begin pushing the piston 81 to the left. As the piston 81 moves to the left, the dielectric fluid 79 will squeeze into the interior of the connector 71, and will flow around the edges of the piston 81, coming into contact with the inner side of the seal 87, and into contact with the connector pin 55. The piston 81 will continue to move inwardly, with the sleeve 83 entering the interior of connector 71, to establish electrical contact between the cable 25 and the sleeve 83. When the sleeve 83 is unable to move any farther inwardly, the connector pin 55 will pierce the piston 81 and enter the interior of the sleeve 83. This establishes electrical contact between the connector pin 55 and the cable 25. The stop 59 (FIG. 1) will prevent any farther movement inwardly of the connector pin 55. The insulator 65 will be in abutment with the piston 45, shielding the connector pin 55, should leakage of sea water into the housing 33 occur. The pierced seal 89 assists in preventing the entry of sea water.

Submersible pumps must be pulled periodically for maintenance and replacement. When pulling the pump, first hydraulic fluid pressure will be supplied to hose 53 (FIG. 1) to move the connector pin 55 outwardly. The connector pin 55 will withdraw into passage 41, and the slit 43 will close to prevent sea water from entering passage 41. Then, hydraulic fluid pressure is supplied to hose 51 (FIG. 1) to cause piston 45 to move outwardly. This retracts the outer insulator 35, removing its sealing face 39 from recess 89, and from the passage 13. A handling tool (not shown) generally as shown in U.S. Pat. No. 4,003,428, will be lowered to connect with the neck 23 to pull the submersible pump through the passage 13 and to the surface. When the pump is being lowered again, after maintenance, the insulator 75, sleeve 83, seal 87, and piston 81 are replaced with another unit filled with dielectric fluid 79. The same connector pins 55 and insulators 35 can be actuated to make the electrical connection.

The invention has significant advantages. The connections are made remotely by the use of hydraulic pistons, and without significant contact of the electrical connectors with contaminating liquid contained in the Christmas tree. The penetrable seal and the silicon gel further protect the contacts from the entry of contaminating liquid.

While the invention has been shown in only one of its forms, it should be apparent to those skilled in the art that it is not so limited but is susceptible to various changes without departing from the scope of the invention.

We claim:

1. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an inner insulator carried by the suspension head means;

an electrical connector sleeve connected to the internal cable and carried in the inner insulator;

a resilient, outer insulator movably carried in a passage extending laterally through a wall of the tubular member, and having a sealing face facing inwardly, the outer insulator having a passage therethrough that terminates in a slit at the sealing face;

an electrical connector rod movably carried in the passage of the outer insulator and connected to the external cable, the connector rod being movable relative to the sealing face between a recessed position with its tip recessed within the outer insulator with the slit being closed to prevent the entry of sea water to a protruding position protruding through the slit past the sealing face for entering the connector sleeve; and hydraulic piston means for moving the outer insulator relative to the tubular member into engagement with the suspension head means while the connector rod remains in the recessed position, then for moving the connector rod relative to the tubular member from the recessed position to the protruding position into electrical engagement with the connector sleeve while the outer insulator remains stationary.

2. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an inner insulator carried by the suspension head means and having a sealing face facing outwardly;

an electrical inner connector connected to the internal cable and carried in the inner insulator;

a resilient outer insulator movably carried in a laterally extending passage and having a sealing face facing inwardly;

an electrical outer connector movably carried in a passage in the outer insulator and connected to the external cable;

insulator piston means hydraulically actuated for moving the outer insulator while the outer connector remains stationary from an outer position to an inner position with the sealing face of the outer insulator in sealing engagement with the sealing face of the inner insulator; and connector piston means hydraulically actuated for moving the outer connector while the outer insulator is in the inner position between a recessed position within the outer insulator and a protruding position protruding outwardly past the sealing face into electrical engagement with the inner connector.

3. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an insulator carried by the suspension head means;

an electrical inner connector connected to the internal cable and carried in the insulator;

a cavity located in the insulator radially outward from the inner connector and containing a dielectric liquid in communication with the inner connector;

a penetrable piston constructed of electrical insulation material and located in the cavity, the piston movable from an outer position on the outer side of the cavity to an inner position substantially in contact with the inner connector;

an electrical outer connector connected to the external cable and movably carried in a passage extending laterally through a wall of the tubular member;

piston means for moving the outer connector inwardly to move the penetrable piston into the inner position and to penetrate the penetrable piston, then to enter the cavity and electrically engage the inner connector; and by-pass passage means located in the cavity for allowing some of the dielectric liquid to flow around the penetrable piston to surround the outer connector as the penetrable piston is moved inwardly.

4. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an insulator carried by the suspension head means;

an electrical inner connector sleeve connected to the internal cable and carried in the insulator;

a cavity located in the insulator radially outward from the inner connector and containing a dielectric liquid in communication with the connector sleeve;

a penetrable piston constructed of electrical insulation material and located in the cavity, the penetrable piston being movable from an outer position sealingly located on the outer side of the cavity to an inner position substantially in contact with the connector sleeve;

an electrically conductive outer connector sleeve adapted to fit within the inner connector sleeve, having a closed interior and an open end which is mounted to the inner side of the penetrable piston for movement therewith;

an electrical connector rod connected to the external cable and movably carried in a passage extending laterally through a wall of the tubular member;

piston means for moving the connector rod inwardly to move the penetrable piston to the inner position to pierce the penetrable piston, then enter the outer connector sleeve and move the outer connector sleeve inwardly into the inner connector sleeve in electrical engagement with the inner connector sleeve; and by-pass passage means located in the cavity for allowing some of the dielectric liquid to flow around the piston to surround the connector rod as the piston is moved inwardly.

5. In a subsea wellhead assembly having a tubular member, suspension head means for locating in the tubular member and suspending a submersible pump, an improved connection means for making an electrical connection to a cable extending from the pump to the suspension head means, comprising in combination:

an electrical inner insulator carried by the suspension head means and having a sealing face facing outwardly;

an electrical inner connector carried in the inner insulator and connected to the cable;

a resilient electrical outer insulator movably carried in a passage extending through a wall of the tubular member and having a sealing face facing inwardly;

an electrical outer connector carried in the outer insulator for independent movement relative to the outer insulator;

a hydraulic housing mounted to the tubular member;

an insulator piston mounted to the outer insulator and located in the housing;

hydraulic supply and return lines leading into the housing on opposite sides of the insulator piston for moving the outer insulator while the outer connector remains stationary between an outer position with its sealing face recessed in the wall of the tubular member to an inner position with its sealing face in sealing engagement with the inner insulator;

a connector piston mounted to the outer connector and located in the housing outwardly of the insulator piston; and hydraulic supply and return lines leading into the housing on opposite sides of the connector piston for moving the outer connector into and out of engagement with the inner connector while the outer insulator remains stationary.

6. In a subsea wellhead assembly having a tubular member, suspension head means for locating in the tubular member and suspending a submersible pump, an improved connection means for making an electrical connection to a cable extending from the pump to the suspension head means, comprising in combination:

an electrical inner insulator carried by the suspension head means and having a sealing face facing outwardly;

an electrical inner connector carried in the inner insulator and connected to the cable;

a resilient electrical outer insulator movably carried in a passage extending through a wall of the tubular member and having a sealing face facing inwardly;

an electrical outer connector carried in the outer insulator for independent movement relative to the outer insulator;

a hydraulic housing mounted to the tubular member;

an insulator piston mounted to the outer insulator and located in the housing;

hydraulic supply and return lines leading into the housing on opposite sides of the insulator piston for moving the outer insulator while the outer connector remains stationary between an outer position with its sealing face recessed in the wall of the tubular member to an inner position with its sealing face in sealing engagement with the inner insulator;

a connector piston mounted to the outer connector and located in the housing outwardly of the insulator piston;

hydraulic supply and return lines leading into the housing on opposite sides of the connector piston for moving the outer connector into and out of engagement with the inner connector while the outer insulator remains stationary; and a connector insulator surrounding the outer connector between the pistons, the length of the connector insulator being selected so as to sealingly engage the pistons when the outer connector is engaging the inner connector and the outer insulator is in the inner position, to avoid contamination of the outer connector with sea water should the housing leak.

7. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an insulator carried by the suspension head means;

an electrical inner connector sleeve connected to the internal cable and carried in the insulator;

a cavity located in the insulator radially outward from the inner connector sleeve and containing a dielectric liquid in communication with the connector sleeve;

a penetrable piston constructed of electrical insulation material and located in the cavity, the piston being movable from an outer position sealingly located on the outer side of the cavity to an inner position substantially in contact with the inner connector sleeve;

a stationary membrane seal mounted in the cavity on the outer side of the penetrable piston for sealing the cavity from sea water;

an electrically conductive outer connector sleeve adapted to fit within the inner connector sleeve, having a closed interior and an open end which is mounted to the inner side of the penetrable piston for movement therewith;

an electrical connector rod connected to the external cable and movably carried in a passage extending laterally through a wall of the tubular member;

piston means for moving the connector rod inwardly to pierce the membrane and move the penetrable piston inwardly to the inner position with the outer connector sleeve located within the inner connector sleeve, the connector rod piercing the penetrable piston and then entering the outer connector sleeve in electrical engagement with the inner connector sleeve; and by-pass passage means located in the cavity for allowing some of the dielectric liquid to flow around the penetrable piston to surround the connector rod as the penetrable piston is moved inwardly.

8. In a subsea wellhead assembly having a tubular member, suspension head means for locating in the tubular member and suspending a submersible pump, an improved connection means for making an electrical connection from an external cable to an internal cable extending from the pump to the suspension head means, comprising in combination:

an inner insulator carried by the suspension head means;

an electrical connector sleeve connected to the internal cable and carried in the inner insulator;

a cavity located in the inner insulator radially outward from the connector sleeve and containing a dielectric liquid in communication with the connector sleeve;

a penetrable piston constructed of electrical insulation material and located in the cavity, the piston being movable from an outer position on the outer side of the cavity to an inner position substantially in contact with the connector sleeve;

a resilient outer insulator movably carried in a passage extending laterally through a wall of the tubular member, having a sealing face facing inwardly;

an electrical connector rod carried in the outer insulator and connected to the external cable, the connector rod being movable relative to the outer insulator between a recessed position sealed within the outer insulator and a protruding position, protruding through the sealing face; and hydraulic piston means for moving the outer insulator into contact with the inner insulator while the connector rod remains in the recessed position, then for moving the connector rod from the recessed position to the protruding position while the outer insulator remains stationary, moving the piston to the inner position and penetrating the piston to engage the connector sleeve; and by-pass passage means located in the cavity for allowing some of the dielectric liquid to flow around the piston to surround the connector rod as the piston is moved inwardly.

* * * * *